US009613631B2

(12) United States Patent
Arakawa et al.

(10) Patent No.: US 9,613,631 B2
(45) Date of Patent: Apr. 4, 2017

(54) NOISE SUPPRESSION SYSTEM, METHOD AND PROGRAM

(75) Inventors: Takayuki Arakawa, Tokyo (JP); Masanori Tsujikawa, Tokyo (JP)

(73) Assignee: NEC CORPORATION, Tokyo (JP)

( * ) Notice: Subject to any disclaimer, the term of this patent is extended or adjusted under 35 U.S.C. 154(b) by 2123 days.

(21) Appl. No.: 11/489,594

(22) Filed: Jul. 20, 2006

(65) Prior Publication Data

US 2007/0027685 A1 Feb. 1, 2007

(30) Foreign Application Priority Data

Jul. 27, 2005 (JP) ..... 2005-217694

(51) Int. Cl.
*G10L 21/00* (2013.01)
*G10L 21/02* (2013.01)
*G10L 21/0208* (2013.01)

(52) U.S. Cl.
CPC ..... *G10L 21/0208* (2013.01)

(58) Field of Classification Search
CPC .. G10L 21/0208; G10L 21/0272; G10L 25/18
USPC ..... 704/226, 227, 228
See application file for complete search history.

(56) References Cited

U.S. PATENT DOCUMENTS 5,359,695 A * 10/1994 Ohora et al. ..... 704/235
5,390,280 A * 2/1995 Kato et al. ..... 704/233
5,577,161 A * 11/1996 Pelaez Ferrigno ..... 704/226
5,655,057 A 8/1997 Takagi
5,749,068 A * 5/1998 Suzuki ..... 704/233
5,943,429 A * 8/1999 Handel ..... 381/94.2
6,415,253 B1 * 7/2002 Johnson ..... 704/210
6,591,234 B1 * 7/2003 Chandran et al. ..... 704/225
6,643,619 B1 * 11/2003 Linhard et al. ..... 704/233
6,910,011 B1 6/2005 Zakarauskas
7,231,347 B2 6/2007 Zakarauskas
7,266,494 B2 * 9/2007 Droppo et al. ..... 704/228
7,359,857 B2 * 4/2008 Mahe et al. ..... 704/228
7,453,963 B2 * 11/2008 Joublin et al. ..... 375/346
7,483,831 B2 * 1/2009 Rankovic ..... 704/225
7,584,097 B2 * 9/2009 Yao ..... 704/233
7,590,529 B2 * 9/2009 Zhang et al. ..... 704/226
2002/0116177 A1 * 8/2002 Bu et al. ..... 704/200.1
(Continued)

FOREIGN PATENT DOCUMENTS

JP 7-191689 7/1995
JP 11-327593 11/1999
(Continued)

OTHER PUBLICATIONS

S. Kamath, and P. Loizou "A Multi-Band Spectral Subtraction Method for enhancing Speech corrupted by colored Noise" in Proceedings of ICASSP, 2002.*
(Continued)

*Primary Examiner* — Michael Ortiz Sanchez
(74) *Attorney, Agent, or Firm* — McGinn IP Law Group, PLLC

(57) ABSTRACT

Disclosed is a noise suppression system including a unit for calculating a noise mean spectrum from an input signal, a unit for deriving the provisional estimate speech from the input signal and the noise mean spectrum, a reference speech pattern, and a unit for correcting the provisional estimate speech using the reference pattern.

27 Claims, 12 Drawing Sheets

(56) References Cited

U.S. PATENT DOCUMENTS

| | | | | |
|---|---|---|---|---|
| 2003/0177007 | A1* | 9/2003 | Kanazawa et al. | 704/233 |
| 2003/0225577 | A1* | 12/2003 | Deng et al. | 704/226 |
| 2004/0002858 | A1* | 1/2004 | Attias et al. | 704/226 |
| 2004/0064307 | A1 | 4/2004 | Scalart et al. | |
| 2004/0172241 | A1* | 9/2004 | Mahe et al. | 704/205 |
| 2004/0230428 | A1* | 11/2004 | Choi | 704/226 |
| 2005/0119882 | A1* | 6/2005 | Bou-Ghazale | 704/227 |
| 2005/0143989 | A1* | 6/2005 | Jelinek | 704/226 |
| 2006/0136203 | A1* | 6/2006 | Ichikawa | 704/226 |
| 2006/0271362 | A1* | 11/2006 | Katou et al. | 704/233 |
| 2007/0027685 | A1* | 2/2007 | Arakawa et al. | 704/226 |
| 2007/0055505 | A1* | 3/2007 | Doclo et al. | 704/226 |
| 2007/0106504 | A1* | 5/2007 | Deng et al. | 704/226 |

FOREIGN PATENT DOCUMENTS

| | | |
|---|---|---|
| JP | 2003-507764 | 2/2003 |
| JP | 2003-216180 | 7/2003 |
| JP | 2004-520616 | 7/2004 |
| JP | 2005-84653 | 3/2005 |
| WO | 01/13364 A1 | 2/2001 |

OTHER PUBLICATIONS

R. Martin, "Speech Enhancement Using MMSE Short Time Spectral Estimation with Gamma Distributed Speech Priors," in Proc. IEEE Intl. Conf. Acoustics, Speech, Signal Processing (ICASSP), vol. I, pp. 253-256, 2002.*

Japanese Office Action dated Nov. 4, 2009 with partial English-language translation.

Takayuki Arakawa: "Model-Based Wiener Filter for noise robust speech recognition" IEIC Technical Report, vol. 2005, No. 127, p. 151-152, Dec. 22, 2005, The Institute of Electronics, Information and Communication Engineers, Japan.

Hiroshi Matsumoto, "Speech Recognition Techniques for Noisy Environments", Information Science Technological Forum FIT2003, Sep. 10, 2003.

Y. Ephraim. D. Malah, "Speech Enchancement Using a Minimum Mean-Square Error Short-Time Spectral Amplitude Estimator", IEEE Trans. on ASSP-32, No. 6, pp. 1109-1121, Dec. 1984.

M.J.F. Gales and S.J. Young, "Robust Continuous Speech Recognition Using Parallel Model Combination", IEEE Trans. SAP-4, No. 5, pp. 352-359, Sep. 1996.

J.C. Segura A. de la Torre, M.C. Benitez and A.M. Peinado "Model-Based Compensation of the Additive Noise for Continuous Speech Recogition Experiments Using Aurora II Database and Tasks", EuroSoeech '01, vol. 1, pp. 221-224, 2001.

Rainer Martin, "Noise Power Spectral Density Estimation Based on Optimal Smoothing and Minimum Statistics", IEEE Trans. on Speech and Audio Processing, vol. 9, vol. 5, Jul. 2001.

ETSI ES 202 050 VI. 1. 1. "Speech Processing, Transmission and Quality aspects (SQ); Distributed speech recognition; Advanced front-end feature extraction algorithm; Compression algorithms", 2002.

Guorong Xuan. Wei Zhang. Peiqi Chai. "EM Algorithms of Gaussian Mixture Model and Hiden Markov Model", IEEE International Conference on Image Processing ICIP 2001, vol. 1, pp. 145-148, Oct. 2001.

* cited by examiner

NOISE SUPPRESSION SYSTEM, METHOD AND PROGRAM

FIELD OF THE INVENTION

This invention relates to a noise suppression system and, more particularly, to a noise suppression system, a noise suppression method and a noise suppression program, which are suited for suppressing noise component in speech recognition.

BACKGROUND OF THE INVENTION

The conventional noise suppression technique for speech recognition may roughly be classified into the following two types.

(a) The noise component is subtracted from an input signal using a signal processing technique.

(b) An acoustic model and a noise model are synthesized on a decoder to create a noise adapted acoustic model.

Meanwhile, in the present specification, the noise designates a signal other than the speech signal, and includes, in addition to a background noise, thought to be relatively stationary, the unexpectedly occurring noise, reverberation, echo and the speech of speaker other than a target speaker, for example.

According to Patent Document 1, the techniques (a) and (b) are classified as the technique by the front end and processing by a decoder, respectively.

A method widely used as the signal processing technique (a) is a "spectrum subtraction method (abbreviated as SS method)".

FIG. 10 is a diagram showing a typical configuration of a system for implementing this SS method. Referring to FIG. 10, the system includes an input signal acquisition unit 1 for acquiring an input signal (spectrum X), a unit 2 for calculating a noise mean spectrum (N), and a unit 3*c* for subtracting the noise mean spectrum from the input signal to calculate an estimate speech (provisional estimate speech S').

The system of this configuration has the following advantages.

An amount of computation is small.

The system may readily be used in combination with other techniques, such as a technique of updating the noise mean spectrum.

However, if the noise mean spectrum is simply subtracted from the input signal, the residual noise in the subtraction (musical noise) is generated due to variance components of the noise or to the phase difference between the speech and the noise. Such residual noise may give rise to recognition error.

Thus, in the SS method, it is necessary to carry out flooring by way of processing for burying the information in the valley of the speech. In case the flooring level is increased, the residual noise, generated in the subtraction process, may be suppressed, however, the performance may be degraded because the information in the valley of the speech has been buried.

In Patent Document 1, Non-Patent publication 2 and in Non-Patent publication 6, there is disclosed a technique of calculating a noise reducing filter using a smoothed a priori SNR (estimate speech divided by the noise mean spectrum).

Referring to FIG. 11, this system includes, in addition to the configuration shown in FIG. 10, a unit 6 for calculating a noise reducing filter and a unit 7 for calculating the estimate speech. The system of FIG. 11 uses smoothing to reduce the residual noise, which is of a problem inherent in the above SS method.

If smoothing is carried out thoroughly, the residual noise in the subtraction may be suppressed, however, there persist problems such as

- dropout of the beginning portion of the speech and
- difficulties met in detecting the terminal portion of the speech.

That is, the signal processing technique suffers from the following problem:

- Processing such as flooring or smoothing is which leads to dropout of the information of the original speech, has to be carried out.
- If, as the residual noise, generated in the subtraction process, is suppressed, the information dropout is to be reduced to a minimum, it is necessary to carry out parameter tuning, depending on the sort of the noise and on the SNR.

It is therefore difficult to make universal use of the signal processing technique.

Turning to the technique of (b) for adapting the acoustic model to the noise, there is widely known the "Parallel Model Combination (PMC) Method" disclosed in Non-Patent Document 3.

This technique uses a unit for formulating a noise model, an acoustic model HMM, learned in advance in a noise-free environment, a unit for transforming the noise model to a linear spectrum, and a unit for transforming the acoustic model HMM to linear spectrum. The technique also uses a unit for adding the noise model, transformed into the linear spectrum, and the acoustic model HMM, also transformed into the linear spectrum, to formulate a noise adapted acoustic model HMM, and a unit for transforming the so formulated noise adapted model to cepstrum.

The system of this configuration has the following advantages.

That is, since the acoustic model HMM has been adapted to the noise, recognition may be achieved without dependency on the sort of the noise or on the SNR.

However, there persist the following problems.

The computation for formulating the noise adapted acoustic model NMM is extremely costly.

It is not that easy to use the technique in combination with other techniques, such as the technique for updating the noise mean spectrum.

As a method for adapting not the acoustic model but reference pattern GMM (Gaussian Mixture Model) of the speech to the noise, the "method for speech signal estimation by GMM" has been proposed in Non-Patent Document 4.

Referring to FIG. 12, this technique uses an input signal acquisition unit 1, for acquiring an input signal X, a unit 2 for calculating the noise mean spectrum, and reference pattern 4 of the speech, learned in advance in a noise-free environment. The technique also uses a noise adapted pattern formulating unit 9, for formulating noise adapted pattern, the noise adapted pattern 10, and a unit 11 for calculating an expected value of the amount of movement of mean vectors of the noise pattern and the reference pattern. The technique also uses a calculation unit 7*a* for calculating the estimate speech S.

The system, configured as described above, has the following merit.

That is, the system is able to perform speech recognition with high stability by replacing the operation of subtracting the noise component, which has been of a problem in the above-described signal processing technique, by the operation of finding the expected value of the variance G between the reference pattern and the noise adaptive patterns.

Similarly to the PMC method, the system, having the above configuration, suffers from the following problem.

The computation for formulating the noise adaptive acoustic model NMM is extremely costly.

It is not that easy to use the system in combination with other techniques, such as the technique of updating the noise mean spectrum.

[Patent Document 1]

JP Patent Kohyo Publication No. JP-P2004-520616A

[Non-Patent Document 1]

Hiroshi Matsumoto, "Speech Recognition Techniques for Noisy Environments", Information Science Technological Forum FIT2003, Sep. 10, 2003

[Non-Patent Document 2]

Y. Ephraim. D. Malah, "Speech Enhancement Using a Minimum Mean-Square Error Short-Time Spectral Amplitude Estimator", IEEE Trans. on ASSP-32, No. 6, pp. 1109-1121, December 1984

[Non-Patent Document 3]

M. J. F. Gales and S. J. Young, "Robust Continuous Speech Recognition Using Parallel Model Combination", IEEE Trans. SAP-4, No. 5, pp. 352-359, September 1996

[Non-Patent Document 4]

J. C. Segura A. de la Torre, M. C. Benitez and A. M. Peinado "Model-Based Compensation of the Additive Noise for Continuous Speech Recognition Experiments Using AURORA II Database and Tasks", EuroSpeech '01, Vol. 1, pp. 221-224, 2001

[Non-Patent Document 5]

Rainer Martin, "Noise Power Spectral Density Estimation Based on Optimal Smoothing and Minimum Statistics", IEEE Trans. on Speech and Audio Processing, Vol. 9, No. 5, July 2001

[Non-Patent Document 6]

ETSI ES 202 050 VI. 1. 1. "Speech Processing, Transmission and Quality aspects (STQ); Distributed speech recognition; Advanced front-end feature extraction algorithm; Compression algorithms", 2002

[Non-Patent Document 7]

Guorong Xuan. Wei Zhang. Peiqi Chai. "EM Algorithms of Gaussian Mixture Model and Hidden Markov Model", IEEE International Conference on Image Processing ICIP 2001, vol. 1, pp. 145-148, October 2001

SUMMARY OF THE DISCLOSURE

As described above, the conventional systems suffer from the following problems.

The first problem is that, with the signal processing technique, flooring or smoothing has to be carried out, such that dropout of the information of the original speech may be produced from time to time. The reason is that, under a highly noisy environment, variance of the noise or the effect of the phase difference between the speech and the noise may hardly be disregarded, such that residual noise may be generated in subtracting the noise mean spectrum from the input speech.

The second problem is that, with the signal processing technique, parameter tuning becomes necessary depending on the sort of the noise or on the SNR. The reason is that a parameter for reducing information dropout to a minimum while suppressing the residual noise may be found out only empirically.

The third problem is that, with the technique of adapting the acoustic model or the reference pattern to the noise, it is difficult to combine a method for updating the noise mean spectrum to the time varying noise to adapt the acoustic model or the reference pattern to the noise from frame to frame. The reason is that it is necessary to carry out calculation at a high cost for adapting the acoustic model or the reference pattern to the noise.

Accordingly, it is an object of the present invention to provide a system, a method and a computer program product with which it is possible to remove noise components to high accuracy without causing dropout of the speech information.

It is another object of the present invention to provide a system, a method and a computer program product for noise suppression in which the number of tuning parameters may be reduced and which are not sensitive to the values of the tuning parameters.

It is yet another object of the present invention to provide a system, a method and a computer program product for noise suppression in which computation cost may be reduced and in which time variations of the noise may be followed easily.

The above and other objects are attained by the invention summarized substantially as follows:

A first system according to the present invention includes means for calculating a noise mean spectrum from an input signal, means for deriving the provisional estimate speech in a spectral domain from the input signal and the noise mean spectrum, and means for correcting the provisional estimate speech using reference pattern of the speech stored in a storage unit.

A first noise suppressing method according to the present invention includes the steps of:

calculating a noise mean spectrum from an input signal;

deriving the provisional estimate speech in a spectral domain from the input signal and the noise mean spectrum; and correcting the provisional estimate speech using reference pattern of the speech.

A first computer program according to the present invention includes the program for causing a computer, receiving an input signal for suppressing the noise for estimating the speech, to execute the processing of calculating the noise mean spectrum from the input signal, the processing of deriving the provisional estimate speech in a spectral domain from the input signal and from the noise mean spectrum, and the processing of correcting the provisional estimate speech using the reference pattern of the speech.

With this configuration, the residual noise, produced by subtraction, may be corrected, on the basis of the reference pattern, so that the first object of the present invention may be achieved.

Moreover, certain inaccuracies of the provisional estimate noise may be tolerated, so that expectations may be made for processing which need not be sensitive to the tuning parameter values, and hence the second object of the present invention may be achieved.

In addition, since it is unnecessary to adapt the reference pattern to the noise, the cost for computations may be reduced, while the noise may be followed easily, so that the third object of the present invention may be achieved.

A second noise suppressing method according to the present invention is such a method which, in the first noise suppression method, further comprises the steps of:

transforming the provisional estimate speech derived in the spectral domain, into a feature vector; and correcting the provisional estimate speech, transformed into the feature vector, using the reference pattern in a feature vector area.

A third noise suppression method according to the present invention is such a method in which, in the first or second noise suppression method, a probability distribution is presupposed as the reference pattern, an expected value of the speech is found from the probability that the probability distribution forming the reference pattern outputs the provisional estimate speech, and from a mean value of the probability distribution forming the reference pattern, and the expected value of the speech is used as a value for correction of the provisional estimate speech.

A fourth noise suppression method according to the present invention is such a method in which, in the step of correcting the provisional estimate speech, in the first or second noise suppression method, the provisional estimate speech is corrected, using the reference pattern formed by a plurality of speech patterns, and the reference pattern, which is closest to the input speech, is selected for use as a value for correction of the provisional estimate speech, or a plurality of speech patterns, closer to the input speech, are averaged with weights variable with distances for use as a value for correction of the provisional estimate speech.

A fifth noise suppression method according to the present invention is such a method in which, in any of the first to fourth noise suppression methods, the step of correcting the provisional estimate speech includes a step of finding the standard deviation of the noise. The standard deviation of the noise, thus found, is taken into account in controlling the provisional estimate speech.

A sixth noise suppressing method according to the present invention is such a method which, in any of the first to fifth noise suppression methods, further includes a step of calculating a noise reducing filter from the value for correction of the provisional estimate speech and from the noise mean spectrum, and a step of applying filtering by the noise reducing filter to the input signal to derive an estimate speech.

A seventh noise suppression method according to the present invention is such a method in which, in the sixth noise suppression method, the noise reducing filter is calculated using the input signal in addition to using the provisional estimate speech as corrected and the noise mean spectrum.

An eighth noise suppression method according to the present invention is such a method in which, in calculating the noise reducing filter in the sixth or seventh noise suppression method, the provisional estimate speech as corrected or the a priori SNR (signal to noise ratio) obtained on dividing the corrected provisional estimate speech with the noise mean spectrum, is smoothed in at least one of the time domain, frequency domain and the domain of the number of dimensions of the feature vector.

A ninth noise suppression method according to the present invention is such a method in which, in any of the first to eighth noise suppression methods, the operation of setting the provisional estimate speech, as corrected using the reference pattern, as provisional estimate speech, and of correcting the provisional estimate speech again using the reference pattern, is carried out a plural number of times.

A tenth method according to the present invention is such a method in which, in any of the first to ninth methods, the step of calculating the noise mean spectrum from the input signal calculates the noise spectrum from at least one of the plural input signals, and the step of deriving the provisional estimate speech finds the provisional estimate speech from at least one of the plural input signals, and from the noise spectrum.

A speech recognition method according to the present invention includes a step of recognizing the noise-suppressed speech using any of the first to tenth noise suppression methods.

A second computer program according to the present invention is such a program in which, in the first program, the processing of correcting the provisional estimate speech includes the processing of transforming the provisional estimate speech derived in the spectral domain, into a feature vector, and the processing of correcting the provisional estimate speech, transformed into the feature vector, using the reference pattern in a feature vector area.

A third computer program according to the present invention is such a program in which, in the first or second program, the processing of correcting the provisional estimate speech presupposes a probability distribution as the reference pattern, and an expected value of the speech is found from the probability that the probability distribution forming the reference pattern outputs the provisional estimate speech and from a mean value of the probability distribution forming the reference pattern. The expected value of the speech is used as a value for correction of the provisional estimate speech.

A fourth computer program according to the present invention is such a program in which, in the first or second program, the processing of correcting the provisional estimate speech, using the reference pattern made up of a plurality of speech patterns, and the reference pattern which is closest to the input speech is selected for use as a value for correction of the provisional estimate speech, or a plurality of speech patterns, closer to the input speech, are averaged with weights variable with distances, for use as a value for correction of the provisional estimate speech.

A fifth computer program according to the present invention is such a program in which, in any one of the first to fourth programs, the processing of correcting the provisional estimate speech includes the processing of finding the standard deviation of the noise and controls the correction as the standard deviation of the noise is taken in to account.

A sixth computer program according to the present invention is such a program which, in any one of the first to fifth programs, allows the computer to further execute the processing of calculating a noise reducing filter from the provisional estimate speech as corrected and from the noise mean spectrum, and the processing of applying filtering by the noise reducing filter to the input signal to derive the estimate speech.

A seventh computer program according to the present invention is such a program in which, in the sixth program, the processing of calculating the noise reducing filter calculates the noise reducing filter using the input signal in addition to using the estimate noise as corrected and the noise mean spectrum.

An eighth computer program according to the present invention is such a program in which, in the sixth or seventh program, the estimate speech as corrected or the a priori SNR, obtained on dividing the corrected estimate speech by the noise mean spectrum, is smoothed in at least one of the time domain, frequency domain and the domain of the number of dimensions of the feature vector.

A ninth computer program according to the present invention is such a program in which, in any one of the first to eighth programs, the processing of setting the estimate speech, which has been obtained by correcting the provisional estimate speech the using the reference pattern, as a provisional estimate value, and correcting the provisional estimate value again using the reference pattern, is repeated a plural number of times.

A tenth computer program according to the present invention is such a program in which, in any one of the first to ninth programs, the processing of calculating a noise mean spectrum calculates the spectrum of the noise from at least one of a plurality of input signals, and the processing of deriving the provisional estimate speech from the input signal and from the noise mean spectrum finds the provisional estimate speech from at least one of the input signals and from the noise spectrum.

An eleventh computer program according to the present invention allows a computer, making up a speech recognition apparatus, to receive a noise-suppressed speech signal to execute speech recognition, by any one of the first to tenth programs.

The meritorious effects of the present invention are summarized as follows.

According to the present invention, the residual noise of the provisional estimate noise may properly be corrected using the knowledge of the reference pattern.

According to the present invention, the provisional estimate noise may be inaccurate, to a more or less extent, and hence there may be expected processing which is not particularly sensitive to the values of the tuning parameters.

According to the present invention, there is no necessity for adapting the reference pattern to the noise, and hence the costs for calculations may be reduced, while the noise may be followed readily.

Still other features and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

Figure 1:
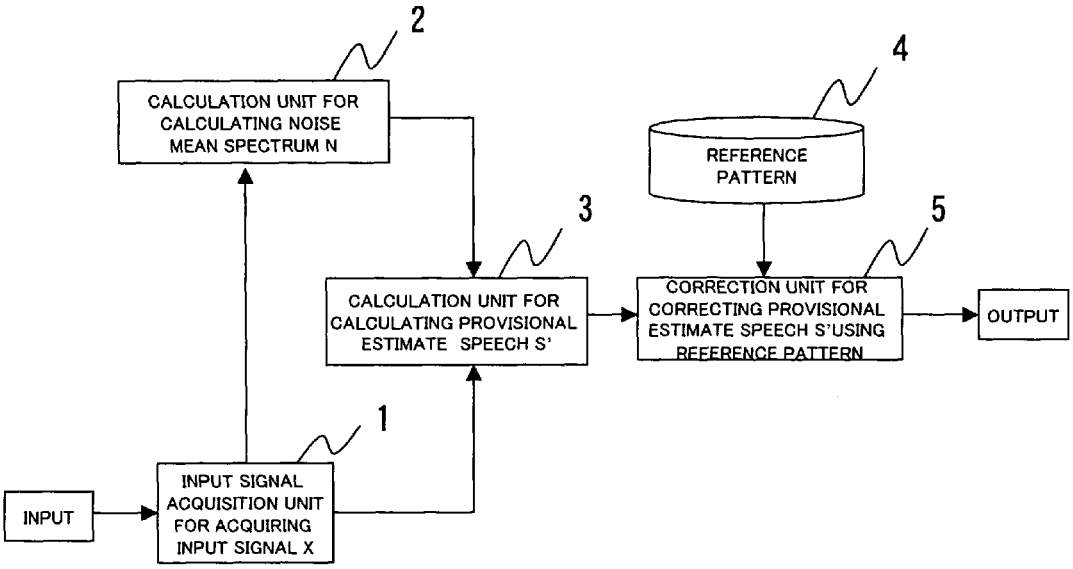
FIG. 1 is a block diagram showing the configuration of a noise suppression system according to a first embodiment of the present invention.

Referring to the drawings, the present invention will now be described in further detail.

Figure 2:
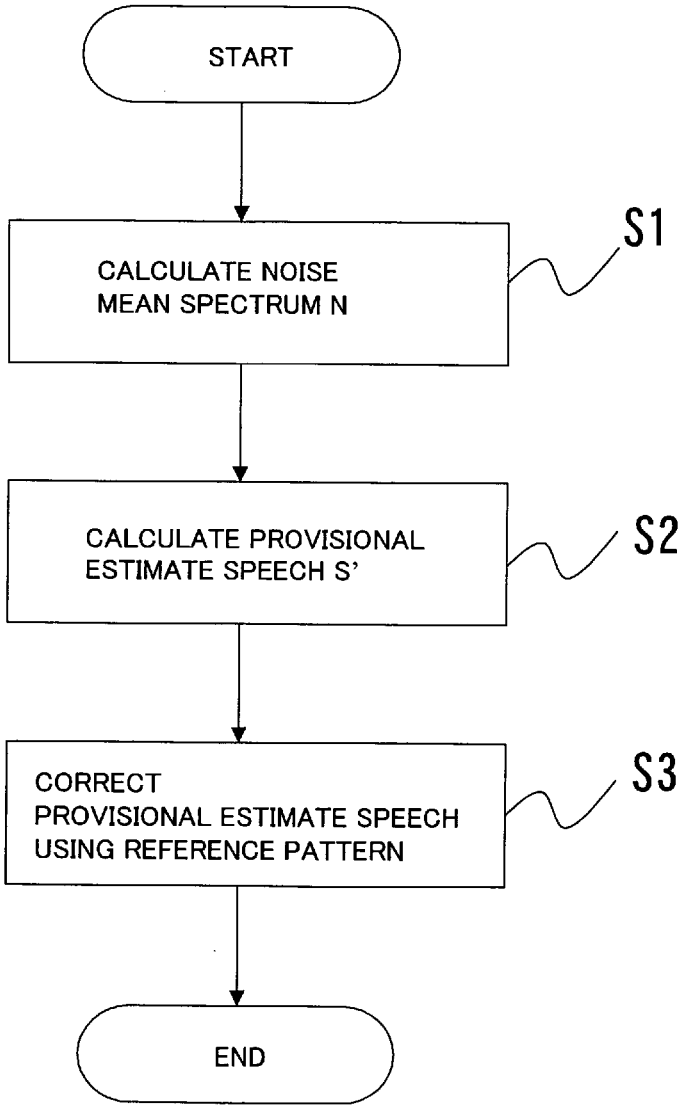
FIG. 2 is a flowchart for illustrating the processing steps in the noise suppression system according to the first embodiment of the present invention.

FIG. 1 shows a system configuration of a first embodiment of the present invention. Referring to FIG. 1, the system of the first embodiment of the present invention includes an input signal acquisition unit 1 for acquiring an input signal (input signal spectrum X), a noise mean spectrum calculation unit 2 for calculating a noise mean spectrum N from the input signal X acquired from the input signal acquisition unit 1, a provisional estimate speech calculation unit 3 for calculating a provisional estimate speech S' from the input signal X acquired from the input signal acquisition unit 1 and from the noise mean spectrum N calculated by the noise mean spectrum calculation unit 2, a reference pattern 4 stored in a storage unit and a provisional estimate speech correction unit 5 for correcting the provisional estimate speech, obtained by the provisional estimate speech calculation unit 3, using the reference pattern 4, and for outputting the corrected provisional estimate speech. FIG. 2 is a flowchart for illustrating the processing operation of the first embodiment of the present invention. Referring to FIG. 1 and FIG. 2, the operation of the system of the present embodiment in its entirety will be explained in detail.

Let the input signal spectrum X be expressed as X(f, t).

It is noted that f stands for the frequency filter bank number (f=1, . . . , Lf, where Lf is the number of the frequency filter banks) and t stands for the frame numbers (t=1, 2, . . . ). The input signal spectrum X(f, t) is obtained by executing short-time frame based spectrum analysis of the speech information acquired in the input signal acquisition unit 1, for example, by a microphone.

The noise mean spectrum calculation unit 2 calculates the noise mean spectrum N (f, t) from the input signal spectrum X(f, t) (step S1).

In calculating the noise mean spectrum N (f, t), any of the following techniques, for example, may be used.

A mean value of tens of frames, as from the beginning end, of the input signal spectrum X(f, t), is used.

Tens of frames of the input signal spectrum X(f, t) buffered are sorted and a spectral value standing in a predetermined place such as second or third from the minimum spectral value, is used. Reference is made to, for example, the description of the above Non-Patent Document 5. This Non-Patent Document 5 describes the method of estimating the power spectral density in the nonstationary state, given a noise-corrupted speech signal. This method of estimation is combined with the speech enhancement algorithm which is in need of an estimate value of the noise power spectral density.

A speech section and a non-speech section are found, and a mean value of the input signal spectrum X(f, t) in the non-speech section is used. Reference is made to, for example, the disclosure of the Non-Patent Document 6.

Figure 10:
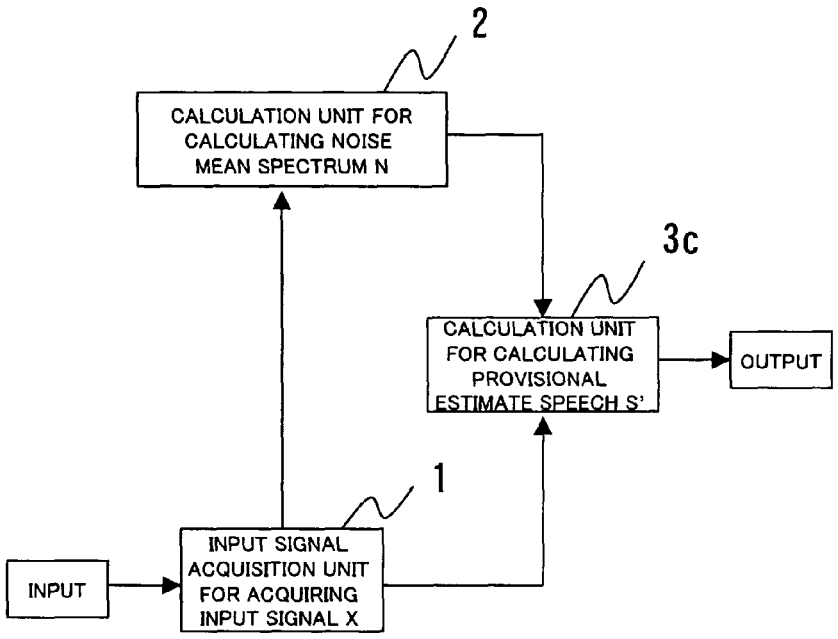
FIG. 10 PRIOR ART
FIG. 10 is a block diagram showing the configuration of a noise suppression system employing a conventional method (SS method).
Figure 11:
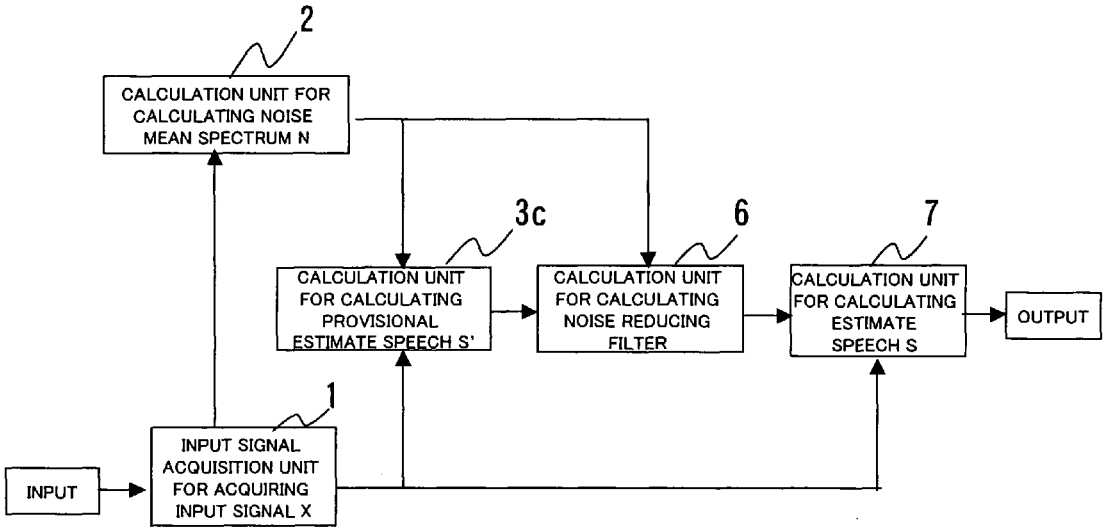
FIG. 11 PRIOR ART
FIG. 11 is a block diagram showing the configuration of a noise suppression system employing a conventional method (Wiener filter employing smoothed a priori SNR).
Figure 12:
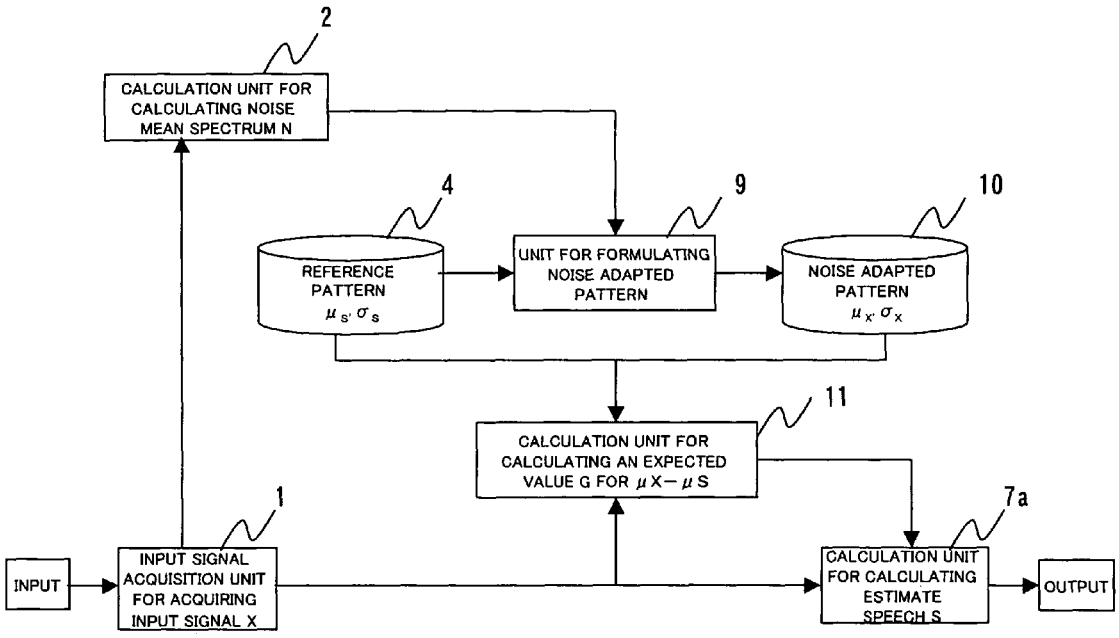
FIG. 12 PRIOR ART
FIG. 12 is a block diagram showing the configuration of a noise suppression system employing a conventional method (a speech signal estimating method which is based on GMM).

The provisional estimate speech calculation unit 3 then calculates a provisional estimate noise S' (f, t), by known techniques, such as SS method (see FIG. 10), or a Wiener filter employing a smoothed a priori SNR (see FIG. 11) using the input signal spectrum X(f, t), and the noise mean spectrum N(f, t), as calculated by the noise mean spectrum calculation unit 2 (step S2).

If the SS method is used, the provisional estimate noise S' (f, t) may be calculated as follows:

$$S'(f,t)=\max(X(f,t)-N(f,t),\alpha N(f,t)) \quad (1).$$

where $\alpha$ is a flooring parameter.

In the present embodiment, it is assumed that the reference pattern 4 includes the reference pattern of speech, obtained on learning in advance in a noise-free environment, although this is not to be restrictive. Or, the reference pattern 4 may include the reference pattern of the speech, obtained on learning under a known noise. As for details of the learning method for learning the reference pattern, reference is made to, for example, the disclosure of the Non-Patent Document 7. In this Non-Patent Document 7, there are stated EM (Expectation-Maximum) algorithms for the GMM (Gaussian Mixed Model) and the algorithm of the HMM.

In the present embodiment, it is assumed that the reference pattern 4 hold the pattern of the speech in the form of a cepstrum GMM, for example. However, the reference pattern held may, of course, be any other suitable features, such as log spectrum GMM, linear spectrum GMM or LPC (Linear Prediction Coding) cepstrum GMM. It is also possible to use the probability distribution other than the mixed Gaussian distribution.

The provisional estimate speech correction unit 5 corrects the provisional estimate speech S' (f, t), as calculated by the provisional estimate speech calculation unit 3, using the reference pattern 4 (step S3).

A more specific example of the above-described correcting method will now be described.

First, the a posteriori probability of the provisional estimate speech for the k-th Gaussian distribution is determined as follows:

$$P(k|S'(f,t))=W^{(k)}p(S'(f,t)|\mu s^{(k)},\sigma s^{(k)})/\Sigma_k W^{(k)}p(S'(f,t)|\mu s^{(k)},\sigma s^{(k)}) \quad (2).$$

where k is a suffix of the Gaussian distribution as the GMM element (k=1, . . . K, K being a number of the mixture), W(k) is the weight of the k-th Gaussian distribution, and p(S'|μs(k), σs(k)) is the probability with which the Gaussian distribution having the mean value μs(k) and the variance σs(k) outputs the estimate speech S'.

In the present embodiment, the provisional estimate speech S' which is transformed into the form of a cepstrum which conforms to the form of the speech pattern held in the reference pattern 4.

Of course, if the form of the speech pattern, held in the reference pattern 4, is changed, the form of the provisional estimate speech S' is changed.

Then, using the above a posteriori probability, an expected value of the speech $$<S(f,t)>=\Sigma_k \mu_s^{(k)} P(k|S'(f,t)) \quad (3)$$

is found and output as being a value for correction of the provisional estimate speech S'.

<S(f, t)> is an estimate value of the speech which is an input signal from which the noise has been removed.

The meritorious effect of the present invention will now be described.

In the present embodiment, the provisional estimate speech is corrected, using the reference pattern for the speech. Hence, the distortion of the estimate speech, produced by the estimation error by the variance of the noise, or by the estimation error caused by the phase difference between the speech and the noise may be corrected.

It is seen from above that, with the present embodiment, the problem of the conventional signal processing technique may be solved.

In the present embodiment, the estimate speech is corrected by the reference speech pattern. Hence, the margin of the tuning parameter, such as a flooring parameter, determined by the equation (1), is enlarged so that the tuning parameter may be incorrect to a more or less extent.

Moreover, in the present embodiment, in which it is unnecessary to adapt the reference pattern to the noise, computation cost is reduced, and hence an algorithm for estimating the time-varying noise may be used for the noise mean spectrum calculation unit 2. Thus, the noise tracking may be made easy.

In the first embodiment, at least one of units 1, 2, 3 and 5 may be implemented by a computer program, which may be recorded in a medium and loaded on a computer constituting a noise suppression system to cause the computer to execute the function/processing of the associated unit.

Figure 3:
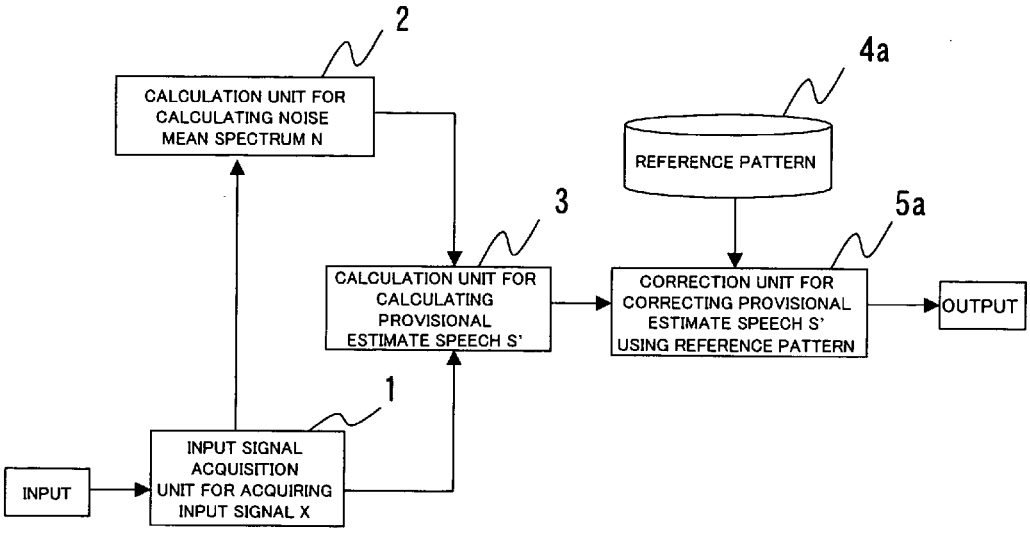
FIG. 3 is a block diagram showing the configuration of a noise suppression system according to a second first embodiment of the present invention.

A second embodiment of the present invention will now be described with reference to the drawings. FIG. 3 is a diagram showing the configuration of the second embodiment of the present invention. Referring to FIG. 3, in the second embodiment, there is provided a reference pattern 4*a* which holds a plural number of mean values of the speech, in place of the reference pattern 4 in the first embodiment, which holds the pattern in the from of probability distribution (see FIG. 1). The provisional estimate speech correction unit 5 in the first embodiment (see FIG. 1) which corrects the provisional estimate speech using the expected value of the speech, is changed to a provisional estimate speech correction unit 5*a* adapted for correcting the provisional estimate speech using a mean value of the speech.

A more specific example of the above correction will be described below. Initially, the distances between the provisional estimate speech S' (f, t) and the reference pattern composed by plural speech patterns (for example, the mean values of the speech patterns) are compared. Here, the above distances between the speech and the reference pattern are compared in the form of the log spectrum. The distances between the speech and the reference pattern may also be compared in other forms, such as in the form of the cepstrum.

$$d^{(k)}=\Sigma_f(S'(f,t)-\mu_s^{(k)}(f))^2 \quad (4)$$

where f is the frequency filter bank number (f=1, . . . , Lf, Lf being the number of the frequency filter banks), k=1, . . . K, K being the number of the reference patterns and $\mu_s^{(k)}$ is a mean value of the patterns k of the speech forming the reference pattern.

If the provisional estimate noise S' (f, t) is in some other form, f becomes some other suffix.

Then, such k which will minimize the distance between the provisional estimate noise S' (f, t) and the reference speech pattern is selected and the corresponding value of S'(f, t) is replaced by a corresponding reference pattern which is to be used as a correction value. Or, a plural number of k's, which will give smaller values of the distance, are selected, and the corresponding values of S'(f, t) are averaged with weights depending on the distances. The resulting averaged value is then used as a correction value. Meanwhile, the distances need not be limited to squares of the distances, such that other optional forms of the distances, such as absolute values, may also be used.

In the second embodiment, the computation cost may be reduced.

In the second embodiment, at least one of units 1, 2, 3 and 5*a* may be implemented by a computer program, which may be recorded in a medium and loaded on a computer constituting a noise suppression system to cause the computer to execute the function/processing of the associated unit.

Figure 4:
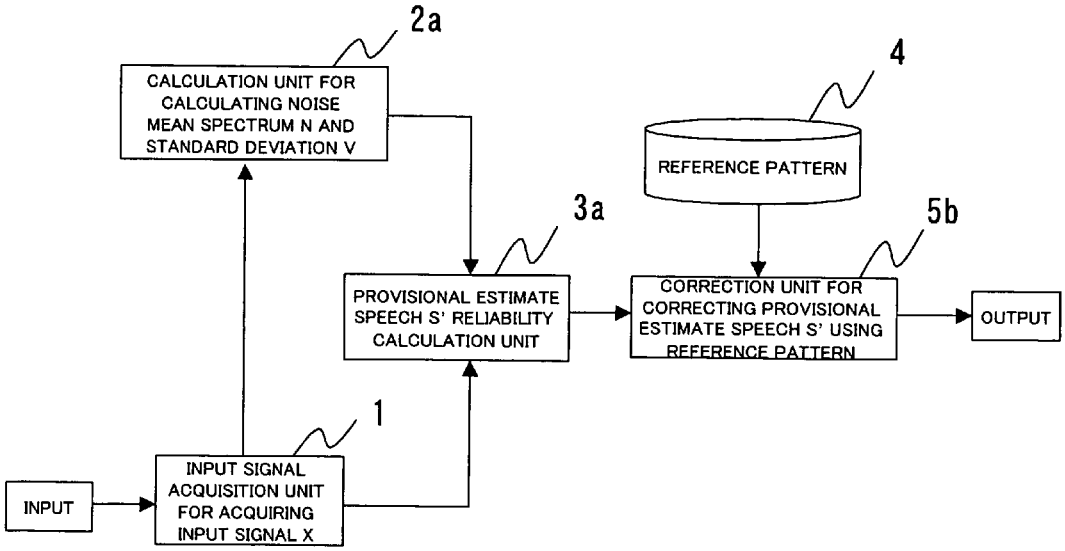
FIG. 4 is a block diagram showing the configuration of a noise suppression system according to a third first embodiment of the present invention.

A third embodiment of the present invention will now be described. FIG. 4 is a diagram showing the configuration of the third embodiment of the present invention. In the third embodiment, shown in FIG. 4, there is provided a noise mean spectrum/standard deviation calculation unit 2*a* in place of the noise mean spectrum calculation unit 2 in the first embodiment of FIG. 1. The noise mean spectrum/standard deviation calculation unit 2*a* is adapted for calculating the noise mean spectrum and the standard deviation of the noise from the input signal acquired from the input signal acquisition unit 1, Moreover, the provisional estimate speech calculation unit 3 of FIG. 1 is changed to a provisional estimate speech/reliability calculation unit 3*a* which calculates a provisional estimate speech and reliability of the provisional estimate speech from an input signal acquired by the input signal acquisition unit 1 and from the noise mean spectrum and the standard deviation of the noise as calculated by the noise mean spectrum/standard deviation calculation unit 2*a*. The provisional estimate speech correction unit 5 in the first embodiment, which uses the reference pattern, is changed to a provisional estimate speech correction unit 5*b*, which uses the reference pattern and which corrects the provisional estimate speech by taking account of the value of the provisional estimate speech and the reliability of the provisional estimate speech.

The points of difference of the operation of the present embodiment from that of the first embodiment will now be described.

The noise mean spectrum/standard deviation calculation unit 2*a* calculates the noise mean spectrum N(f, t), from the input signal spectrum X(f, t), using a technique similar to that used by the noise mean spectrum calculation unit 2. In addition, the noise mean spectrum/standard deviation calculation unit calculates the standard deviation of the noise V(f, t).

The standard deviation of the noise V(f, t) may be calculated by known methods, such as by evaluating the deviation between beginning tens of frames of the input signal spectrum X(f, t) and the noise mean spectrum N(f, t), or finding the speech section and the non-speech section and finding the standard deviation of the input signal spectrum X(f, t) in the non-speech section, to use the standard deviation of the input signal spectrum X(f, t) thus found out as the standard deviation V(f, t) of the noise.

The provisional estimate speech/reliability calculation unit 3*a* finds the provisional estimate speech S' (f, t), using a technique similar to that used by the provisional estimate speech calculation unit 3 of FIG. 1. In addition, the unit 3*a* calculates the reliability of the estimate speech S' (f, t) (estimate error range), using the noise mean spectrum and the standard deviation V(f, t) of the noise calculated by the standard deviation calculation unit 2*a*.

Specifically, as the reliability of S' (f, t), the standard deviation V(f, t) of the noise may directly be used, or the standard deviation V(f, t) of the noise, weighted by a value of a reciprocal of the a posteriori SNR $$\eta(f,t)=X(f,t)/N(f,t) \tag{5}$$

may be used.

The provisional estimate speech correction unit 5*b*, which uses the reference pattern, corrects the provisional estimate speech S' (f, t), calculated by the provisional estimate speech/reliability calculation unit 3*a*, using the reference pattern 4.

At this time, the range of correction is limited, using the reliability of the provisional estimate speech S' (f, t), as calculated by the provisional estimate speech/reliability calculation unit 3*a*.

Specifically, when the value of the provisional estimate speech <S>, as corrected using the reference pattern, is within a range between the provisional estimate speech S' (f, t) plus the standard deviation of the noise V(f, t) and the provisional estimate speech S' (f, t) minus the standard deviation of the noise V(f, t), that is, in case $$S'(f,t)-V(f,t)\leq S(f,t)\leq S'(f,t)+V(f,t) \tag{6}$$

the provisional estimate speech S' (f, t) is replaced by a correction value <S> and, if otherwise, no such replacement is made.

The meritorious effect of the present embodiment will now be described.

In the present embodiment, in which the reliability which is based on the standard deviation of the noise is taken into account in the correction of the provisional estimate speech, it is possible to suppress any marked deviation of the correction by the reference pattern.

In the third embodiment, at least one of units 1, 2*a*, 3*a* and 5*b* may be implemented by a computer program, which may be recorded in a medium and loaded on a computer constituting a noise suppression system to cause the computer to execute the function/processing of the associated unit.

Figure 5:
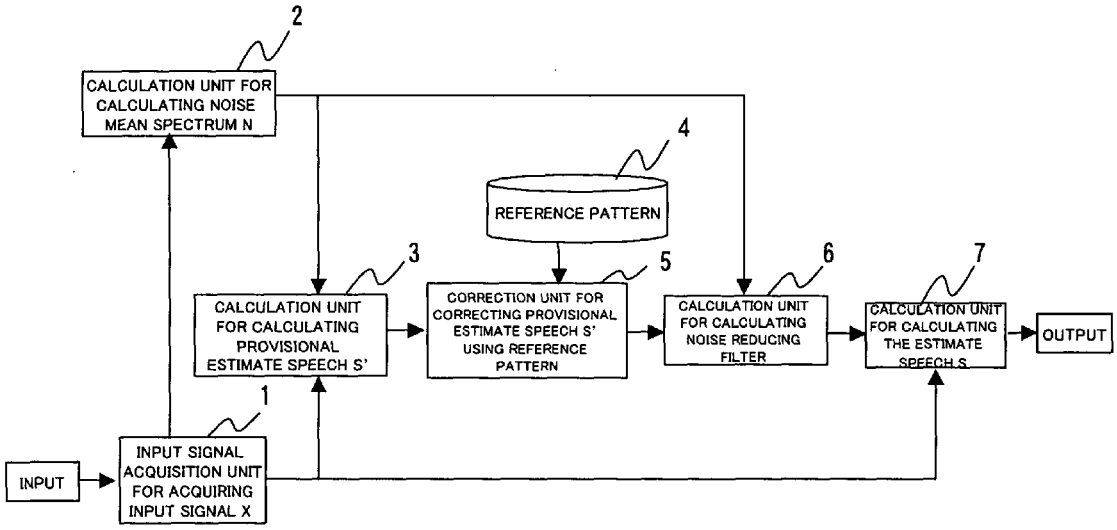
FIG. 5 is a block diagram showing the configuration of a noise suppression system according to a fourth embodiment of the present invention.

A fourth embodiment of the present invention will now be described with reference to the drawings. FIG. 5 is a diagram showing the configuration of the fourth embodiment of the present invention. Referring to FIG. 5, the present fourth embodiment includes a noise reducing filter calculation unit 6 and an estimate speech calculation unit 7, in addition to the configuration of the first embodiment shown in FIG. 1. The noise reducing filter calculation unit 6 calculates a noise reducing filter from the provisional estimate speech, as corrected by the provisional estimate speech correction unit 5, and from the noise mean spectrum, as calculated by the noise mean spectrum calculation unit 2. The estimate speech calculation unit 7 calculates the estimate speech from the noise reducing filter calculated by the noise reducing filter calculation unit 6 and from the input signal spectrum X acquired in the input signal acquisition unit 1.

The operation of the present embodiment will now be described in detail.

The noise reducing filter calculation unit 6 calculates a noise reducing filter from the provisional estimate speech <S(f, t)>, as corrected by the provisional estimate speech correction unit 5, employing the reference pattern, and from the noise mean spectrum N(f, t), as calculated by the noise mean spectrum calculation unit 2.

More specifically, the corrected provisional estimate speech <S(f, t)> is transformed into a linear spectrum to derive the a priori SNR η (f, t) which is given as follows:

$$\eta(f,t)=\langle S(f,t)\rangle/N(f,t) \quad (7).$$

The above a priori SNR η(f, t) may also be found by smoothing, as explained below, using the priori SNR η(f, t−1) of the directly previous frame:

$$\eta(f,t)=\beta\times\eta(f,t-1)+(1-\beta)\times(\langle S(f,t)\rangle/N(f,t) \quad (8)$$

where β (0≤β≤1) is a parameter for controlling the smoothing.

In place of the above example, a frame may be pre-read and several previous and posterior frames may be used for smoothing, and/or smoothed may be made along the frequency axis instead of along the frame direction.

A noise reducing filter W(f, t) is calculated by $$W(f,t)=\eta(f,t)/(1+\eta(f,t)) \quad (9).$$

Finally, the estimate speech calculation unit 7, calculating the estimate speech, calculates the estimate speech S(f, t), by $$S(f,t)=W(f,t)\times X(f,t) \quad (10)$$

from the noise-reducing filter W(f, t), as calculated by the noise reducing filter calculation unit 6, and from the input signal X (f, t), as acquired from the input signal acquisition unit 1.

The meritorious effect of the present embodiment will now be described.

In the present embodiment, the a priori SNR is calculated, using the provisional estimate speech, as corrected, and the finally estimate speech is found using the constructed noise reducing filter. It is possible to avoid quantization with the finite number of speech patterns making up the reference pattern, thereby obtaining the estimate speech of high accuracy.

In the fourth embodiment, at least one of units 1, 2, 3, 5, 6 and 7 may be implemented by a computer program, which may be recorded in a medium and loaded on a computer constituting a noise suppression system to cause the computer to execute the function/processing of the associated unit.

Figure 6:
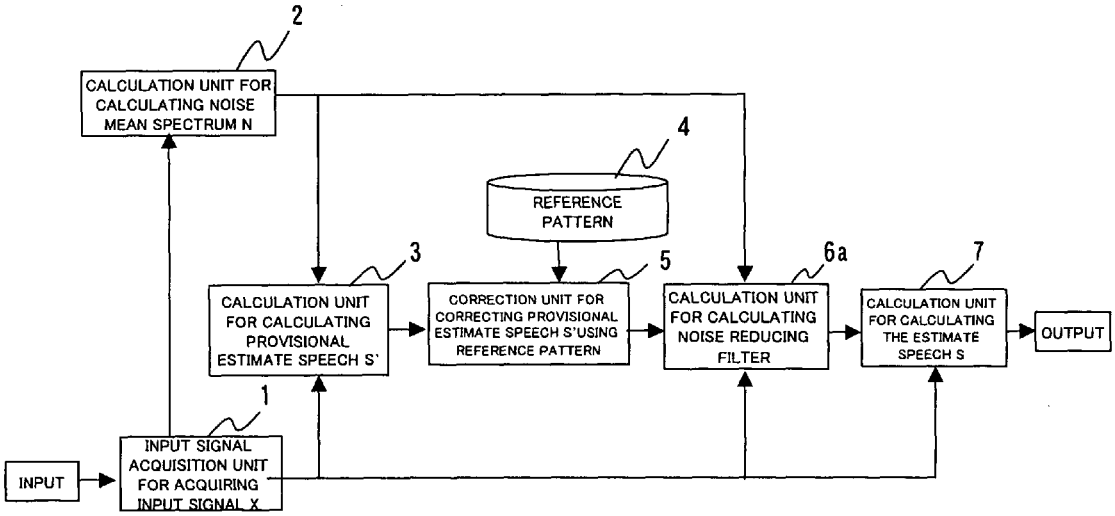
FIG. 6 is a block diagram showing the configuration of a noise suppression system according to a fifth embodiment of the present invention.

FIG. 6 is a diagram showing the configuration of a fifth embodiment of the present invention. The present fifth embodiment, shown in FIG. 6, differs from the fourth embodiment in the following respects. That is, the noise reducing filter calculation unit 6, adapted for calculating the noise reducing filter from the provisional estimate speech, as corrected by the provisional estimate speech correction unit 5, and from the noise mean spectrum, as calculated by the noise mean spectrum calculation unit 2, as used in the fourth embodiment, is changed to a noise reducing filter calculation unit 6*a*. The noise reducing filter calculation unit 6*a* in the present embodiment calculates a noise reducing filter from the provisional estimate speech, as corrected by the provisional estimate speech correction unit 5, from the noise mean spectrum calculated by the noise mean spectrum calculation unit 2, and from the input signal acquired by the input signal acquisition unit 1.

The operation of the present embodiment, differing from that of the fourth embodiment will now be described.

In the present embodiment, the noise reducing filter calculation unit 6*a* derives the a posteriori SNR γ(f, t), from the input signal spectrum X(f, t) and from the noise mean spectrum N(f, t), as follows:

$$\gamma(f,t)=X(f,t)/N(f,t) \quad 11)$$

in addition to finding the a priori SNR η(f, t), using the technique similar to that used in the noise reducing filter calculation unit 6.

As a noise reducing filter W(f, t), the combination of the a priori SNR η(f, t) and the a posteriori SNR γ(f, t), such as the MMSE (minimum mean square error) filter, disclosed in Non-Patent Document 2, is used.

In the fifth embodiment, at least one of units 1, 2, 3, 5, 6*a* and 7 may be implemented by a computer program, which may be recorded in a medium and loaded on a computer constituting a noise suppression system to cause the computer to execute the function/processing of the associated unit.

Figure 7:
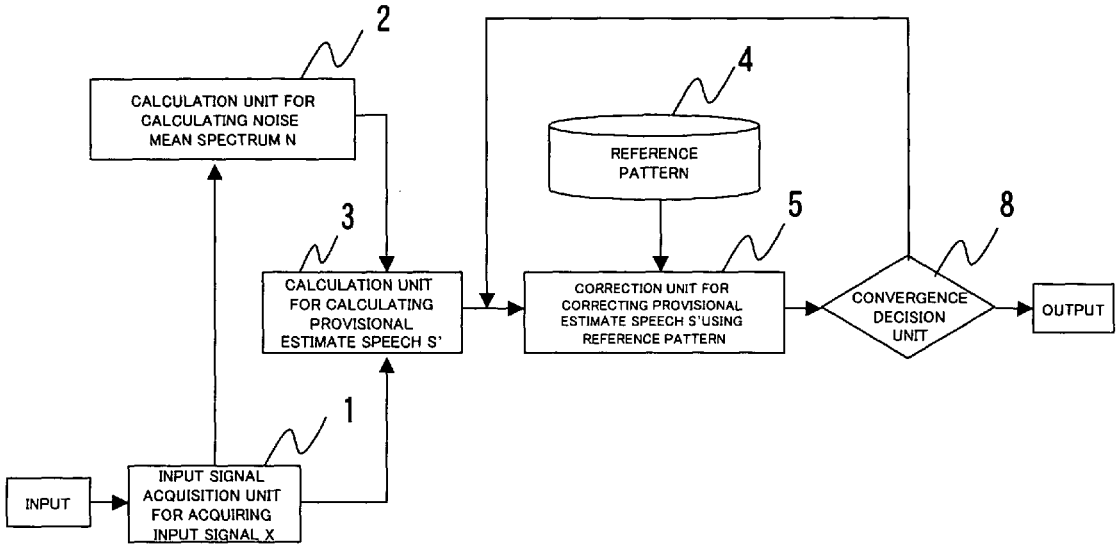
FIG. 7 is a block diagram showing the configuration of a noise suppression system according to a sixth first embodiment of the present invention.

FIG. 7 is a diagram showing the configuration of a sixth embodiment of the present invention. Referring to FIG. 7, the present sixth embodiment includes, in addition to the configuration of the first embodiment, a convergence decision unit 8 operating for supplying the corrected speech, calculated by the provisional estimate speech correction unit 5 using the reference pattern, to an output or again to the correction unit 5 using the reference pattern, if the corrected speech satisfies or does not satisfy a certain condition, respectively.

This condition may, for example, be decision means, such as the processing having been repeated N times, or the difference between a newly calculated correction value and the directly previous correction value being not greater than a predetermined threshold value.

The meritorious effect of the present embodiment will now be explained.

In the present embodiment, a true value can be asymptotically approached by repeatedly carrying out processing, whereby an estimate speech of high accuracy may be produced.

In the sixth embodiment, at least one of units 1, 2, 3, 5 and 8 may be implemented by a computer program, which may be recorded in a medium and loaded on a computer constituting a noise suppression system to cause the computer to execute the function/processing of the associated unit.

Figure 8:
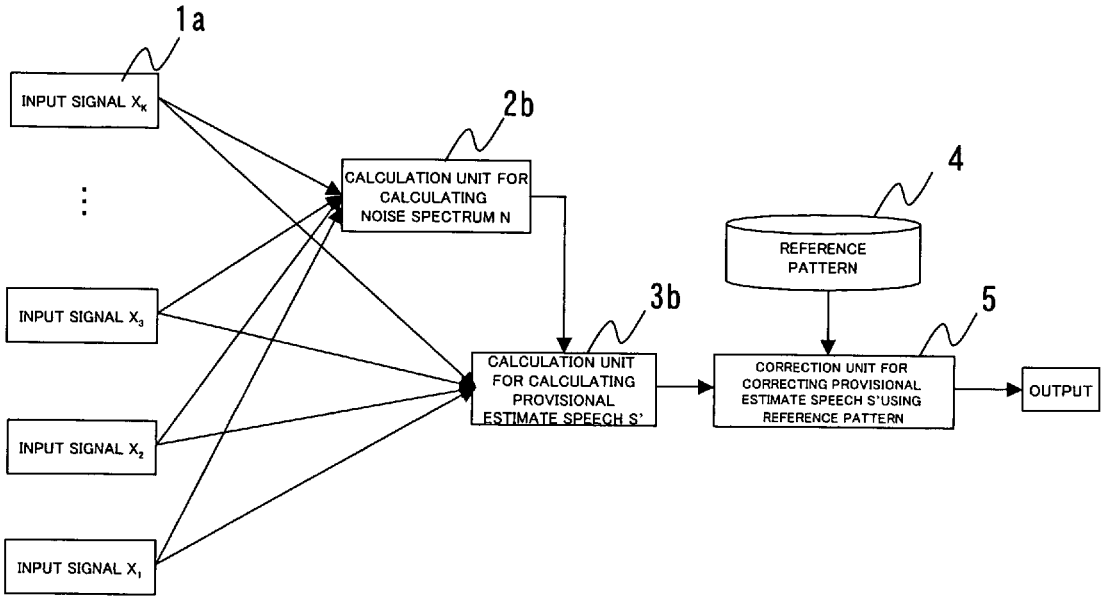
FIG. 8 is a block diagram showing the configuration of a noise suppression system according to a seventh embodiment of the present invention.

FIG. 8 is a diagram showing the configuration of a seventh embodiment of the present invention. Referring to FIG. 8, in the present embodiment, there is provided a unit 1*a* for acquiring a plural number of input signals X1 to XK, as the input signal acquisition unit 1 for acquiring the input signal X, in contrast to the first embodiment. For example, if two microphones are used, one of the microphones is used for inputting the speech, while the other may be used for inputting the noise. Or, the input signals of the two microphones may be processed by summation, subtraction or multiplication by a factor of an arbitrary unit number, and the so processed signal may be transmitted to a provisional estimate speech calculation unit 3*b* and to a noise spectrum calculation unit 2*b*. Of course, a larger number of microphones may also be used.

The meritorious effect of the present embodiment may be depicted as follows:

In the seventh embodiment, in which plural input signals are provided, the provisional estimate speech and the noise spectrum may be improved in accuracy to produce the estimate speech in high accuracy.

In the seventh embodiment, at least one of units 1, 2*b*, 3*b* and 5 may be implemented by a computer program, which may be recorded in a medium and loaded on a computer constituting a noise suppression system to cause the computer to execute the function/processing of the associated unit.

The above-described first to seventh embodiments may be combined together.

Figure 9:
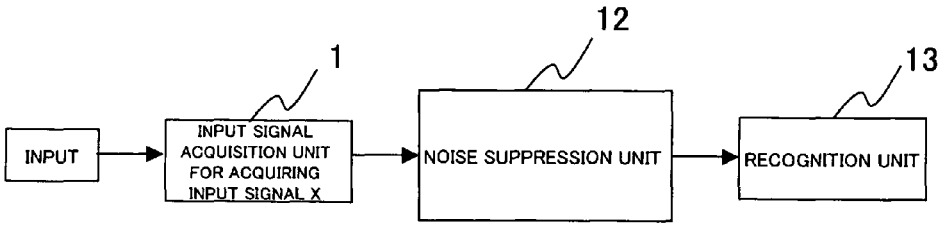
FIG. 9 is a block diagram showing the configuration of a noise suppression system according to an eighth embodiment of the present invention.

FIG. 9 shows the configuration of an eighth embodiment of the present invention. Referring to FIG. 9, the eighth embodiment of the present invention is made up by a noise suppressing unit 12 of the configuration of any of the first to seventh embodiments, used alone, or in combination, and a recognition unit 13 for carrying out speech recognition using the estimate speech output from the noise suppressing unit 12.

In the seventh embodiment, at least one of units 1, 12 and 13 may be implemented by a computer program, which may be recorded in a medium and loaded on a computer constituting a speech recognition system to cause the computer to execute the function/processing of the associated unit.

The meritorious effect of the present embodiment may be depicted as follows:

With the present embodiment, it is possible to construct a recognition system of a high recognition rate even under highly noisy environments.

The configuration of the present invention may be adapted for an application where noise components in a noisy environment are removed to take out only the targeted speech components. The present invention may also be put to a use for speech recognition under noisy environment.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A noise suppression system, comprising:

a unit, as executed by a processor, for successively acquiring an input signal in a spectrum domain;

a unit, as executed by said processor, for successively estimating an instant noise value in the spectrum domain from said input signal;

a unit, as executed by said processor, for deriving a provisional estimate speech in the spectral domain from said input signal and said instant noise value; and a unit, as executed by said processor, for correcting said provisional estimate speech using a reference pattern of speech stored in a storage unit, said correcting using a distribution for said reference pattern as comprising clean speech without a noise contamination, wherein, in said unit for deriving said provisional estimate speech, said provisional estimate speech is derived by suppressing a noise element in said input signal with said instant noise value, and wherein said unit for correcting said provisional estimate speech includes:

a unit for transforming said provisional estimate speech derived in the spectral domain into a feature vector in a logarithmic domain or a cepstrum domain;

a unit for correcting said provisional estimate speech, transformed into said feature vector, using a reference pattern in a feature vector domain;

a unit for transforming said corrected provisional estimate speech in the spectrum domain; and a unit for acquiring an estimate speech by second suppressing, in the spectrum domain, a noise element in said input signal.

2. The noise suppression system according to claim 1, wherein said unit for correcting said provisional estimate speech presupposes a probability distribution as said reference pattern and derives an expected value of speech from a probability that the probability distribution forming said reference pattern outputs the provisional estimate speech and from a mean value of the probability distribution forming said reference pattern, said expected value of speech being used as a value for correction of the provisional estimate speech.

3. The noise suppression system according to claim 1, wherein said unit for correcting said provisional estimate speech corrects the provisional estimate speech, using a reference pattern including a plurality of speech patterns, and wherein a reference pattern which is closest to an input speech is selected and used as a value for a correction of the provisional estimate speech, or a plurality of speech patterns constituting said reference pattern, closer to said input speech, are averaged with weights which are dependent on distances between the provisional estimate speech and the respective speech patterns.

4. The noise suppression system according to claim 1, wherein said unit for correcting said provisional estimate speech finds a standard deviation of noise and takes into account said standard deviation of noise to control said correction of said provisional estimate speech.

5. The noise suppression system according to claim 4, further comprising a unit for calculating said provisional estimate speech and a reliability of said provisional estimate speech from said standard deviation of noise, a value of said provisional estimate speech and the reliability of said provisional estimate speech both being taken into account for performing said correction of said provisional estimate speech.

6. The noise suppression system according to claim 1, further comprising:

a unit for deriving a noise reducing filter from the provisional estimate speech as corrected and from said noise mean spectrum; and an estimate speech calculation unit applying filtering by said noise reducing filter to said input signal and obtaining an estimate speech from an output of said noise reducing filter, wherein said unit for deriving the noise reducing filter includes a unit for transforming said corrected provisional estimate speech derived in a feature vector domain into the spectrum domain.

7. The noise suppression system according to claim 6, wherein said unit for deriving a noise reducing filter constructs said noise reducing filter, using said input signal in addition to using said provisional estimate speech as corrected and said noise mean spectrum.

8. The noise suppression system according to claim 6, wherein said unit for deriving a noise reducing filter smoothes the estimate speech as corrected or an a priori SNR, obtained on dividing the corrected estimate speech in at least one of a time direction, a frequency direction, and a direction of a number of dimensions of a feature vector.

9. The noise suppression system according to claim 6, wherein said unit for deriving a noise reducing filter calculates an a priori SNR η(f, t)

$$\text{SNR } \eta(f,t)=\langle S(f,t)\rangle/N(f,t)$$

where N(f, t) is the noise mean spectrum, <S(f, t)> is the provisional estimate speech, and t is a frame number; and then constructs a noise reducing filter W(f, t)

$$W(f,t)=\eta(f,t)/(1+\eta(f,t))$$

for the a priori SNR η(f, t); and wherein said estimate speech calculation unit calculates S(f, t) by a multiplication in a frequency domain:

$$S(f,t)=W(f,t)\times X(f,t)$$

using said noise reducing filter W(f, t) and the input signal spectrum X(f, t).

10. The noise suppression system according to claim 9, wherein said unit for deriving a noise reducing filter calculates said a priori SNR η(f, t), t being a frame number, on smoothing, with a use of η(f, t−1) of a directly previous frame, in accordance with $\eta(f, t)=\beta\times\eta(f, t-1)+(1-\beta)\times(S(f, t)\rangle/N(f, t)$, where β is a parameter controlling the smoothing and is such that $0\leq\beta\leq1$).

11. The noise suppression system according to claim 6, wherein said unit for deriving a noise reducing filter calculates an a priori SNR η(f, t), on a basis of said noise mean spectrum N(f, t) and on said provisional estimate speech <S(f, t)>, and calculates an a posteriori SNR γ(f, t), on a basis of said noise mean spectrum N(f, t) and said input signal spectrum X(f, t);

said unit for deriving a noise reducing filter uses said noise reducing filter W(f, t) combined with the a priori SNR η(f, t) and the a posteriori SNR γ(f, t); and wherein said estimate speech calculation unit calculates the estimate speech S(f, t) by a multiplication in a frequency domain of the noise reducing filter W(f, t) and the input signal spectrum X(f, t):

$$S(f,t)=W(f,t)\times X(f,t),$$

using said noise reducing filter W(f, t) and the input signal spectrum X(f, t).

12. The noise suppression system according to claim 1, wherein a control is performed so that a processing of setting an estimate speech obtained by correcting said provisional estimate speech using the reference pattern, as a provisional estimate value, and again correcting the provisional estimate value, using said reference pattern, is carried out a plural number of times.

13. The noise suppression system according to claim 1, wherein said unit for calculating a noise mean spectrum calculates the spectrum of the noise from at least one of a plurality of input signals, and wherein said unit for deriving the provisional estimate speech from said input signal and from said noise mean spectrum finds the provisional estimate speech from at least one of said input signals and from said noise spectrum.

14. The noise suppression system according to claim 1, wherein said unit for correcting said provisional estimate speech calculates an a posteriori probability P(k|S'(f, t)) for the provisional estimate speech S'(f, t), t being a frame number, for the k-th Gaussian distribution, defined by the following equation:

$$P(k|S'(f,t))=W^{(k)}p(S'(f,t)|\mu s^{(k)},\sigma s^{(k)})/\Sigma_k W^{(k)}p(S'(f,t)|\mu s^{(k)},\sigma s^{(k)})$$

where k is a suffix of the Gaussian distribution, as an element of the GMM (Gaussian Mixed Model) (k=1, . . . , K, K being a number of mixture), $W^{(k)}$ is a weight of the k-th Gaussian distribution, and $p(S'(f, t)|\mu s^{(k)}, \sigma s^{(k)})$ is a probability of the Gaussian distribution, having a mean value $\mu s^{(k)}$ and a variance $\sigma s^{(k)}$, outputting the estimate speech S', said unit for correcting said provisional estimate speech makes the provisional estimate speech S' (f, t), conform to a form of a speech pattern held by said reference pattern, finding an expected value of the speech $$\langle S(f,t)\rangle=\Sigma_k\mu_s^{(k)}P(k|S'(f,t)),$$

using the a posterior probability P(k|S'(f, t)), and setting the expected speech value, thus found, as a value for correction of the provisional estimate speech S' (f, t).

15. The noise suppression system according to claim 1, wherein said unit for correcting said provisional estimate speech calculates a distance between said provisional estimate speech S' (f, t), t being a frame number, and said reference pattern formed by a plurality of speech patterns:

$$d^{(k)}=\Sigma_f(S'(f,t)-\mu_s^{(k)}(f))^2$$

where f is a frequency filter bank number (f=1, . . . Lf: Lf being a number of the filter banks);

k=1, . . . K, where K is a number of the reference patterns; and $\mu_s^{(k)}$ is a mean value of the speech pattern k forming the reference pattern;

said unit for correcting said provisional estimate speech selecting such k which minimizes distances between the provisional estimate speech S' (f, t) and the reference pattern;

replacing a value of S' (f, t) by a corresponding reference pattern; and setting a resulting value as a value for correction of the provisional estimate speech S' (f, t).

16. The noise suppression system according to claim 1, wherein said unit for correcting said provisional estimate speech finds a distance between said provisional estimate speech S' (f, t), t being a frame number, and said reference pattern formed by a plurality of speech patterns:

$$d^{(k)}=\Sigma_f(S'(f,t)-\mu_s^{(k)}(f))^2$$

where f is a frequency filter bank number (f=1, . . . Lf: Lf being a number of the filter banks);

k=1, . . . K, where K is a number of the reference patterns; and $\mu_s^{(k)}$ is a mean value of the speech patterns k forming the reference pattern;

said unit for correcting said provisional estimate speech selecting a plurality of k's which give smaller distances between the provisional estimate speech S' (f, t) and the reference pattern;

said unit for correcting said provisional estimate speech averaging the k's with weights dependent on the distances;

a resulting averaged value being used as a value for correction of the provisional estimate speech S' (f, t).

17. A signal enhancement system comprising the noise suppression system as set forth in claim 1, wherein the signal enhancement system enhances the speech included in said input signal.

18. A speech recognition system comprising the noise suppression system as set forth in claim 1, said system further comprising a unit for receiving a speech signal, a noise of which has been suppressed by said noise suppression system, for carrying out a speech recognition.

19. A noise suppressing method in which noise is suppressed from an input signal to estimate a speech, said method comprising:

successively acquiring and providing an input signal in a spectrum domain to be an input to a processor;

successively estimating, in said spectrum domain and using said processor, an estimated instant noise value from said input signal;

deriving, using the processor, a provisional estimate speech in the spectral domain from said input signal and said instant noise value;

correcting said provisional estimate speech using a reference pattern of speech stored in a storage unit, said correcting using a distribution of said reference pattern as comprising clean speech without a noise contamination, by transforming said provisional estimate speech derived in the spectral domain into a feature vector in a logarithmic or a cepstrum domain, by correcting said provisional estimate speech transformed into said feature vector by using a reference pattern in a feature vector domain;

transforming said corrected provisional estimate speech in the spectrum domain; and acquiring an estimate speech by suppressing, in the spectrum domain, a noise element in said input signal.

20. The noise suppression method according to claim 19, wherein, in correcting said provisional estimate speech, a probability distribution is presupposed as said reference pattern, an expected value of the speech is found from a probability that the probability distribution forming said reference pattern outputs said provisional estimate speech and from a mean value of the probability distribution forming said reference pattern, said expected value of the speech being used as a value for correction of the provisional estimate speech.

21. The noise suppression system according to claim 19, wherein, in correcting said provisional estimate speech, said provisional estimate speech is corrected, using said reference pattern formed by a plurality of speech patterns, and wherein a reference pattern which is closest to said input speech is selected for use as a value for correction of the provisional estimate speech, or a plurality of speech patterns, closer to said input speech, are averaged with weights variable with distances for use as a value for correction of said provisional estimate speech.

22. The noise suppressing method according to claim 19, further comprising:

calculating a noise reducing filter from a value for correction of the provisional estimate speech and from said noise mean spectrum; and applying filtering by said noise reducing filter to said input signal to obtain an estimate speech.

23. A computer program product for use on a computer, said computer receiving an input signal for suppressing a noise to estimate a speech, said computer program product tangibly embodying a set of machine-readable instructions for causing the computer to execute:

successively acquiring an input signal in a spectrum domain;

successively estimating an instant noise value, in said spectrum domain, from the input signal;

deriving a provisional estimate speech in a spectral domain from said input signal and from said instant noise value;

correcting said provisional estimate speech using a reference pattern of speech stored in a storage unit, said correcting using a distribution of said reference pattern as comprising clean speech without a noise contamination by transforming said provisional estimate speech derived in the spectral domain into a feature vector in a logarithmic domain or a cepstrum domain and transforming said feature vector using a reference pattern in a feature vector domain;

transforming said corrected provisional estimate speech in the spectrum domain; and acquiring an estimate speech by second suppressing, in the spectrum domain, a noise element in said input signal.

24. The computer program product according to claim 23, wherein the correcting said provisional estimate speech presupposes a probability distribution as said reference pattern, and wherein an expected value of the speech is found from a probability that the probability distribution forming said reference pattern outputs the provisional estimate speech and from a mean value of the probability distribution forming said reference pattern, said expected value of the speech being used as a value for correction of the provisional estimate speech.

25. The computer program product according to claim 23, wherein the correcting said provisional estimate speech corrects said provisional estimate speech using the reference pattern formed by a plurality of speech patterns; and wherein a reference pattern which is closest to said input speech is selected for a use as a value for correction of the provisional estimate speech, or a plurality of speech patterns, closer to said input speech, are averaged with weights variable with distances, for the use as the value for correction of said provisional estimate speech.

26. The computer program product according to claim 23, instructions causing said computer to further execute:

calculating a noise reducing filter from the provisional estimate speech as corrected and from said noise mean spectrum; and applying filtering by said noise reducing filter to said input signal to obtain an estimate speech.

27. A computer program product for use on a computer included in a speech recognition apparatus, said computer program product tangibly embodied on a machine-readable storage medium, for causing the computer to execute:

receiving a speech signal, a noise in which has been suppressed by a processing by the instructions set forth in claim 23; and a processing of speech recognition for the speech signal received.

* * * * *